US009684268B2

(12) United States Patent
Kimura

(10) Patent No.: US 9,684,268 B2
(45) Date of Patent: Jun. 20, 2017

(54) IMAGE FORMING APPARATUS INCLUDING CONTROLLER WHICH CONTROLS PRIMARY TRANSFER BIAS AND SECONDARY TRANSFER BIAS

(71) Applicant: KYOCERA Document Solutions Inc., Osaka (JP)

(72) Inventor: Ryosuke Kimura, Osaka (JP)

(73) Assignee: KYOCERA Document Solutions Inc., Osaka (JP)

( * ) Notice: Subject to any disclaimer, the term of this patent is extended or adjusted under 35 U.S.C. 154(b) by 0 days.

(21) Appl. No.: 15/185,121

(22) Filed: Jun. 17, 2016

(65) Prior Publication Data

US 2016/0378024 A1 Dec. 29, 2016

(30) Foreign Application Priority Data

Jun. 24, 2015 (JP) ..... 2015-126906
Mar. 15, 2016 (JP) ..... 2016-051421

(51) Int. Cl.
*G03G 15/16* (2006.01)
*G03G 15/01* (2006.01)
*G03G 15/00* (2006.01)

(52) U.S. Cl.
CPC ..... *G03G 15/1605* (2013.01); *G03G 15/0189* (2013.01); *G03G 15/1675* (2013.01); *G03G 15/6558* (2013.01); *G03G 2215/00767* (2013.01); *G03G 2215/00772* (2013.01); *G03G 2215/00776* (2013.01); *G03G 2215/0132* (2013.01)

(58) Field of Classification Search
CPC ..... G03G 15/1665; G03G 15/0189; G03G 15/1675; G03G 2215/00767; G03G 2215/00772; G03G 2215/00776
USPC ..... 399/66, 299, 302, 388, 390
See application file for complete search history.

(56) References Cited

U.S. PATENT DOCUMENTS 8,005,412 B2 8/2011 Sakashita et al.
2001/0028803 A1* 10/2001 Yoda ..... G03G 15/1675 399/44
2005/0201774 A1* 9/2005 Yamagata ..... B65H 5/062 399/98

(Continued)

FOREIGN PATENT DOCUMENTS

JP 2009128481 A 6/2009

*Primary Examiner* — Sandra Brase
(74) *Attorney, Agent, or Firm* — Studebaker & Brackett PC

(57) ABSTRACT

An image forming apparatus includes a plurality of image carriers, an intermediate transfer body, a plurality of primary transfer members, a secondary transfer member, a first guide member, and a controller. The first guide member guides a recording medium along a conveying direction. The controller controls a primary transfer bias and a secondary transfer bias. A plurality of the primary transfer members include an upstream side primary transfer member and a downstream side primary transfer member. The controller makes an absolute value of the primary transfer bias applied to the downstream side primary transfer member larger than an absolute value of the primary transfer bias applied to the upstream side primary transfer member. The controller lowers an absolute value of the secondary transfer bias when the recording medium separates from the first guide member.

9 Claims, 10 Drawing Sheets

(56) References Cited

U.S. PATENT DOCUMENTS

| | | | | |
|---|---|---|---|---|
| 2010/0209128 | A1* | 8/2010 | Sueoka | G03G 15/1605 399/66 |
| 2011/0229176 | A1* | 9/2011 | Noguchi | G03G 15/0131 399/66 |
| 2015/0309446 | A1* | 10/2015 | Teramoto | G03G 15/16 399/66 |
| 2015/0370200 | A1* | 12/2015 | Rokugawa | G03G 15/1675 399/66 |

* cited by examiner

FIG. 6

RESULT OF EXPERIMENT CONDUCTED TO FIRST FACE OF SHEET UNDER NORMAL TEMPERATURE AND NORMAL HUMIDITY ENVIRONMENT

| | PRIMARY TRANSFER BIAS (-μA) | | | | SECONDARY TRANSFER BIAS (-μA) | | TRANSFER RESULT | | | | |
|---|---|---|---|---|---|---|---|---|---|---|---|
| | Y | C | M | K | DURING CONTACT | AFTER SEPARATION | Y | C | M | K | Blue |
| COMPARATIVE EXAMPLE 1 | 4 | 4 | 4 | 4 | 40 | 40 | × | × | × | × | × |
| COMPARATIVE EXAMPLE 2 | 4 | 4 | 4 | 4 | 40 | 25 | ○ | ○ | ○ | × | ○ |
| COMPARATIVE EXAMPLE 3 | 4 | 4 | 4 | 4 | 40 | 15 | × | × | × | ○ | × |
| COMPARATIVE EXAMPLE 4 | 4 | 4 | 4 | 7 | 40 | 40 | × | × | × | × | × |
| EXAMPLE 1 | 4 | 4 | 4 | 7 | 40 | 25 | ○ | ○ | ○ | ○ | ○ |
| EXAMPLE 2 | 4 | 4 | 4 | 10 | 40 | 25 | ○ | ○ | ○ | ○ | ○ |

TRANSFER RESULT ○: TRANSFER FAILURE DID NOT OCCUR
TRANSFER RESULT ×: TRANSFER FAILURE OCCURRED

FIG. 7

RESULT OF EXPERIMENT CONDUCTED TO SECOND FACE OF SHEET UNDER NORMAL TEMPERATURE AND NORMAL HUMIDITY ENVIRONMENT

| | PRIMARY TRANSFER BIAS (-μA) | | | | SECONDARY TRANSFER BIAS (-μA) | | TRANSFER RESULT | | | | |
|---|---|---|---|---|---|---|---|---|---|---|---|
| | Y | C | M | K | DURING CONTACT | AFTER SEPARATION | Y | C | M | K | Blue |
| COMPARATIVE EXAMPLE 1 | 4 | 4 | 4 | 4 | 40 | 40 | × | × | × | × | × |
| COMPARATIVE EXAMPLE 2 | 4 | 4 | 4 | 4 | 40 | 20 | ○ | ○ | ○ | × | ○ |
| COMPARATIVE EXAMPLE 3 | 4 | 4 | 4 | 4 | 40 | 10 | × | × | × | ○ | × |
| COMPARATIVE EXAMPLE 4 | 4 | 4 | 4 | 6 | 40 | 40 | × | × | × | × | × |
| EXAMPLE 1 | 4 | 4 | 4 | 6 | 40 | 20 | ○ | ○ | ○ | ○ | ○ |
| EXAMPLE 2 | 4 | 4 | 4 | 9 | 40 | 20 | ○ | ○ | ○ | ○ | ○ |

TRANSFER RESULT ○: TRANSFER FAILURE DID NOT OCCUR
TRANSFER RESULT ×: TRANSFER FAILURE OCCURRED

FIG. 8

RESULT OF EXPERIMENT CONDUCTED TO FIRST FACE OF SHEET UNDER HIGH TEMPERATURE AND HIGH HUMIDITY ENVIRONMENT

| | PRIMARY TRANSFER BIAS (-μA) | | | | SECONDARY TRANSFER BIAS (-μA) | | TRANSFER RESULT | | | | |
|---|---|---|---|---|---|---|---|---|---|---|---|
| | Y | C | M | K | DURING CONTACT | AFTER SEPARATION | Y | C | M | K | Blue |
| COMPARATIVE EXAMPLE 1 | 8 | 8 | 8 | 8 | 60 | 60 | × | × | × | × | × |
| COMPARATIVE EXAMPLE 2 | 8 | 8 | 8 | 8 | 60 | 50 | ○ | ○ | ○ | × | ○ |
| COMPARATIVE EXAMPLE 3 | 8 | 8 | 8 | 8 | 60 | 20 | × | × | × | ○ | × |
| COMPARATIVE EXAMPLE 4 | 8 | 8 | 8 | 10 | 60 | 60 | × | × | × | × | × |
| EXAMPLE 1 | 8 | 8 | 8 | 10 | 60 | 50 | ○ | ○ | ○ | ○ | ○ |
| EXAMPLE 2 | 8 | 8 | 8 | 14 | 60 | 50 | ○ | ○ | ○ | ○ | ○ |

TRANSFER RESULT ○: TRANSFER FAILURE DID NOT OCCUR
TRANSFER RESULT ×: TRANSFER FAILURE OCCURRED

FIG. 9

RESULT OF EXPERIMENT CONDUCTED TO SECOND FACE OF SHEET UNDER HIGH TEMPERATURE AND HIGH HUMIDITY ENVIRONMENT

| | PRIMARY TRANSFER BIAS (-μA) | | | | SECONDARY TRANSFER BIAS (-μA) | | TRANSFER RESULT | | | | |
|---|---|---|---|---|---|---|---|---|---|---|---|
| | Y | C | M | K | DURING CONTACT | AFTER SEPARATION | Y | C | M | K | Blue |
| COMPARATIVE EXAMPLE 1 | 8 | 8 | 8 | 8 | 60 | 60 | × | × | × | × | × |
| COMPARATIVE EXAMPLE 2 | 8 | 8 | 8 | 8 | 60 | 50 | ○ | ○ | × | × | × |
| COMPARATIVE EXAMPLE 3 | 8 | 8 | 8 | 8 | 60 | 20 | × | × | ○ | ○ | ○ |
| COMPARATIVE EXAMPLE 4 | 8 | 8 | 8 | 10 | 60 | 60 | × | × | × | × | × |
| EXAMPLE 1 | 8 | 8 | 8 | 10 | 60 | 40 | ○ | ○ | ○ | ○ | ○ |
| EXAMPLE 2 | 8 | 8 | 8 | 14 | 60 | 40 | ○ | ○ | ○ | ○ | ○ |

TRANSFER RESULT ○: TRANSFER FAILURE DID NOT OCCUR
TRANSFER RESULT ×: TRANSFER FAILURE OCCURRED

FIG. 10

RESULT OF EXPERIMENT CONDUCTED TO FIRST FACE OF SHEET UNDER LOW TEMPERATURE AND LOW HUMIDITY ENVIRONMENT

| | PRIMARY TRANSFER BIAS (-μA) | | | | SECONDARY TRANSFER BIAS (-μA) | | TRANSFER RESULT | | | | |
|---|---|---|---|---|---|---|---|---|---|---|---|
| | Y | C | M | K | DURING CONTACT | AFTER SEPARATION | Y | C | M | K | Blue |
| COMPARATIVE EXAMPLE 1 | 3 | 3 | 3 | 3 | 30 | 30 | × | × | × | × | × |
| COMPARATIVE EXAMPLE 2 | 3 | 3 | 3 | 3 | 30 | 25 | ○ | ○ | × | × | × |
| COMPARATIVE EXAMPLE 3 | 3 | 3 | 3 | 3 | 30 | 15 | × | × | ○ | ○ | ○ |
| COMPARATIVE EXAMPLE 4 | 3 | 3 | 3 | 7 | 30 | 30 | × | × | × | × | × |
| EXAMPLE 1 | 3 | 3 | 3 | 7 | 30 | 25 | ○ | ○ | ○ | ○ | ○ |
| EXAMPLE 2 | 3 | 3 | 3 | 11 | 30 | 25 | ○ | ○ | ○ | ○ | ○ |

TRANSFER RESULT ○: TRANSFER FAILURE DID NOT OCCUR
TRANSFER RESULT ×: TRANSFER FAILURE OCCURRED

FIG. 11

RESULT OF EXPERIMENT CONDUCTED TO SECOND FACE OF SHEET UNDER LOW TEMPERATURE AND LOW HUMIDITY ENVIRONMENT

| | PRIMARY TRANSFER BIAS (-μA) | | | | SECONDARY TRANSFER BIAS (-μA) | | TRANSFER RESULT | | | | |
|---|---|---|---|---|---|---|---|---|---|---|---|
| | Y | C | M | K | DURING CONTACT | AFTER SEPARATION | Y | C | M | K | Blue |
| COMPARATIVE EXAMPLE 1 | 3 | 3 | 3 | 3 | 30 | 30 | × | × | × | × | × |
| COMPARATIVE EXAMPLE 2 | 3 | 3 | 3 | 3 | 30 | 25 | ○ | ○ | × | × | × |
| COMPARATIVE EXAMPLE 3 | 3 | 3 | 3 | 3 | 30 | 15 | × | × | × | ○ | × |
| COMPARATIVE EXAMPLE 4 | 3 | 3 | 3 | 7 | 30 | 30 | × | × | × | × | × |
| EXAMPLE 1 | 3 | 3 | 3 | 7 | 30 | 20 | ○ | ○ | ○ | ○ | ○ |
| EXAMPLE 2 | 3 | 3 | 3 | 11 | 30 | 20 | ○ | ○ | ○ | ○ | ○ |

TRANSFER RESULT ○: TRANSFER FAILURE DID NOT OCCUR
TRANSFER RESULT ×: TRANSFER FAILURE OCCURRED

IMAGE FORMING APPARATUS INCLUDING CONTROLLER WHICH CONTROLS PRIMARY TRANSFER BIAS AND SECONDARY TRANSFER BIAS

INCORPORATION BY REFERENCE

This application is based on and claims the benefit of priority from Japanese patent application No. 2015-126906 filed on Jun. 24, 2015, and Japanese patent application No. 2016-051421 filed on Mar. 15, 2016, the entire contents of which are incorporated herein by reference.

BACKGROUND

The present disclosure relates to an image forming apparatus, and in particular to an image forming apparatus having a secondary transfer manner and including an intermediate transfer body.

Conventionally, an image forming apparatus having a secondary transfer manner and including an intermediate transfer body is known.

For example, there is an image forming apparatus having a secondary transfer manner and including a plurality of image carriers configured to carry a toner image, an intermediate transfer body configured to come into contact with a plurality of the image carriers, a plurality of primary transfer members configured to primarily transfer the toner image on a plurality of the image carriers to the intermediate transfer body, a secondary transfer member configured to secondarily transfer the toner image on the intermediate transfer body to a recording medium, and a guide member arranged at an upstream side of the secondary transfer member in a conveying direction of the recording medium and configured to guide the recording medium.

SUMMARY

In accordance with an embodiment of the present disclosure, an image forming apparatus includes a plurality of image carriers, an intermediate transfer body, a plurality of primary transfer members, a secondary transfer member, a guide member, and a controller. A plurality of the image carriers are configured to carry a toner image. The intermediate transfer body is configured to come into contact with a plurality of the image carriers. A plurality of the primary transfer members are configured to primarily transfer the toner image on a plurality of the image carriers to the intermediate transfer body. The secondary transfer member is configured to secondarily transfer the toner image on the intermediate transfer body to a recording medium. The guide member is arranged at an upstream side of the secondary transfer member in a conveying direction of the recording medium and configured to guide the recording medium along the conveying direction. The controller is configured to control both of a primary transfer bias applied to a plurality of the primary transfer members when the toner image on a plurality of the image carriers is primarily transferred to the intermediate transfer body and a secondary transfer bias applied to the secondary transfer member when the toner image on the intermediate transfer body is secondarily transferred to the recording medium. A plurality of the primary transfer members include an upstream side primary transfer member and a downstream side primary transfer member arranged at a downstream side of the upstream side primary transfer member in a running direction of the intermediate transfer body. The controller makes an absolute value of the primary transfer bias applied to the downstream side primary transfer member larger than an absolute value of the primary transfer bias applied to the upstream side primary transfer member. The controller lowers an absolute value of the secondary transfer bias when an upstream end part of the recording medium in the conveying direction separates from the guide member.

The above and other objects, features, and advantages of the present disclosure will become more apparent from the following description when taken in conjunction with the accompanying drawings in which a preferred embodiment of the present disclosure is shown by way of illustrative example.

BRIEF DESCRIPTION OF THE DRAWINGS

FIG. 6 is a table showing a result of an experiment conducted to the first face of the sheet under a normal temperature and normal humidity environment.

FIG. 7 is a table showing a result of an experiment conducted to the second face of the sheet under the normal temperature and normal humidity environment.

FIG. 8 is a table showing a result of an experiment conducted to the first face of the sheet under a high temperature and high humidity environment.

FIG. 9 is a table showing a result of an experiment conducted to the second face of the sheet under the high temperature and high humidity environment.

FIG. 10 is a table showing a result of an experiment conducted to the first face of the sheet under a low temperature and low humidity environment.

FIG. 11 is a table showing a result of an experiment conducted to the second face of the sheet under the low temperature and low humidity environment.

DETAILED DESCRIPTION

Hereinafter, an MFP 1 (image forming apparatus) according to an embodiment of the present disclosure will be described with reference to the drawings. Arrows L, R, U and Lo optionally added to each drawing indicate a left side, a right side, an upper side and a lower side of the MFP 1, respectively.

Firstly, an outline of the configuration of the MFP 1 will be explained.

Figure 1:
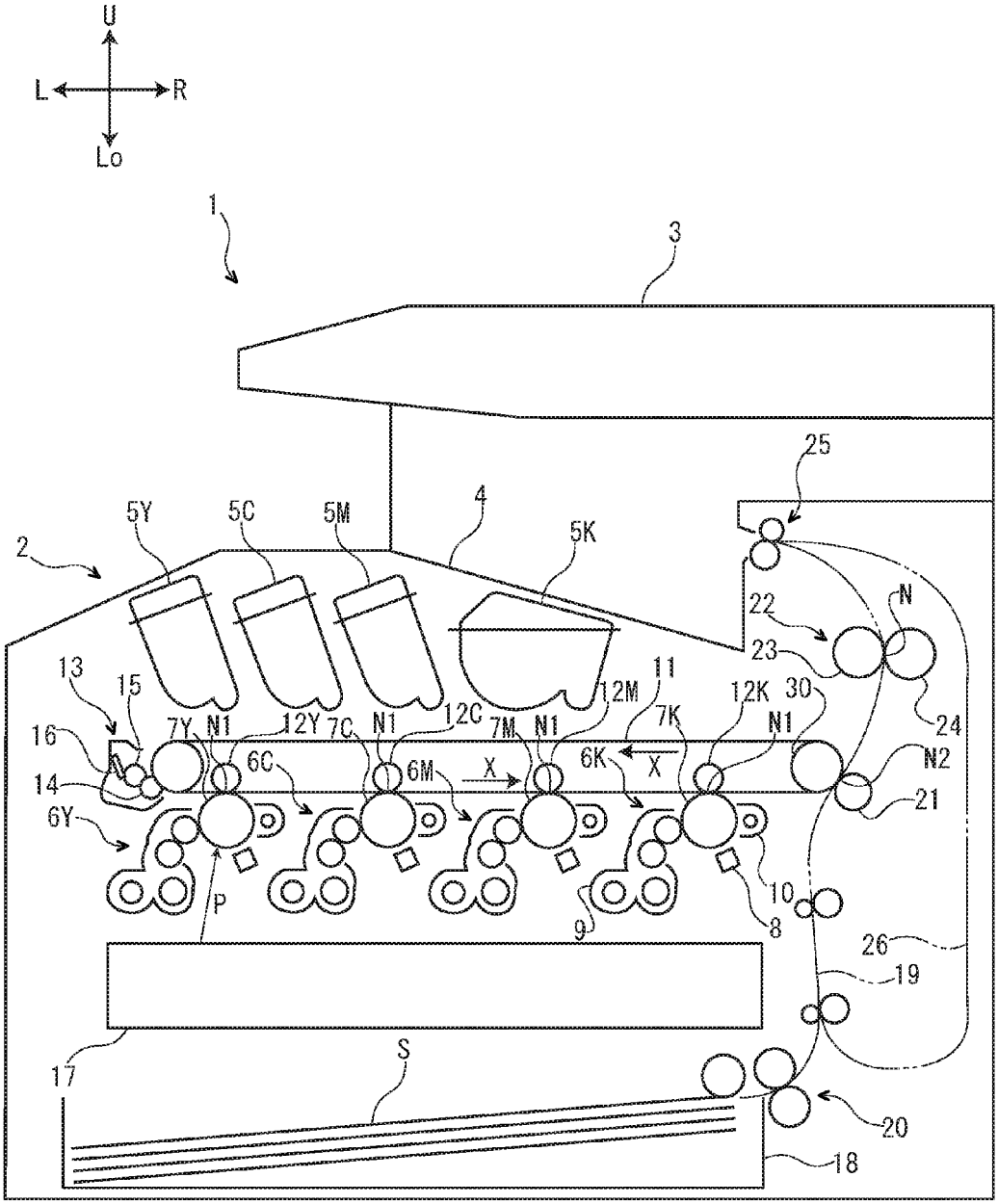
FIG. 1 is a schematic view showing an outline of an MFP (multifunction peripheral) according to an embodiment of the present disclosure.

As shown in FIG. 1, the MFP 1 includes a box-formed MFP main body 2 (apparatus main body). In an upper end part of the MFP main body 2, an image reading device 3 to read an original image is arranged. In an upper part of the MFP main body 2, a sheet ejecting tray 4 is arranged below the image reading device 3. In the upper part of the MFP main body 2, four toner containers 5Y, 5C, 5M, 5K are housed below the sheet ejecting tray 4. Each toner container 5Y, 5C, 5M, 5K contains a toner of yellow, cyan, magenta, and black, respectively.

In the roughly middle part of the MFP main body 2, four image forming parts 6Y, 6C, 6M, 6K are housed. Each image forming part 6Y, 6C, 6M, 6K corresponds to the toner of yellow, cyan, magenta, and black, respectively. Image forming parts 6Y, 6C, 6M, 6K include photosensitive drums 7Y, 7C, 7M, 7K (image carriers), respectively. Each image forming part 6Y, 6C, 6M, 6K is provided with a charger 8, a developing device 9, and a cleaning device 10 around each photosensitive drum 7Y, 7C, 7M, 7K.

In a roughly middle part of the MFP main body 2, an intermediate transfer belt 11 (intermediate transfer body) is arranged above the four image forming parts 6Y, 6C, 6M, 6K. The intermediate transfer belt 11 comes into contact with each photosensitive drum 7Y, 7C, 7M, 7K. The intermediate transfer belt 11 is configured to be runnable in a predetermined direction (see arrows X in FIG. 1).

Inside the intermediate transfer belt 11, four primary transfer rollers 12Y, 12C, 12M, 12K (primary transfer members) are arranged along a lower face of the intermediate transfer belt 11. Each primary transfer roller 12Y, 12C, 12M, 12K corresponds to the toner of yellow, cyan, magenta, and black, respectively. Each primary transfer roller 12Y, 12C, 12M, 12K faces each photosensitive drum 7Y, 7C, 7M, 7K via the intermediate transfer belt 11 and sandwiches the intermediate transfer belt 11 with each photosensitive drum 7Y, 7C, 7M, 7K. According to this, a primary transfer nip N1 is formed between each photosensitive drum 7Y, 7C, 7M, 7K and the intermediate transfer belt 11, respectively. The primary transfer roller 12K (downstream side primary transfer member) is arranged at a downstream side of each primary transfer roller 12Y, 12C, 12M (each upstream side primary transfer member) in a running direction of the intermediate transfer belt 11 (see the arrows X in FIG. 1).

At a left end side of the intermediate transfer belt 11, a cleaning unit 13 is arranged. The cleaning unit 13 includes a cleaning brush 14 configured to come into contact with a surface of the intermediate transfer belt 11, a collecting roller 15 configured to come into contact with the cleaning brush 14, and a cleaning blade configured to come into contact with the collecting roller 15.

In a lower part of the MFP main body 2, a laser scanning device 17 is housed below the four image forming parts 6Y, 6C, 6M, 6K. In a lower end part of the MFP main body 2, a sheet feeding tray 18 is housed below the laser scanning device 17. In the sheet feeding tray 18, a sheet S (recording medium) is accommodated.

At a right side part of the MFP main body 2, a conveying path 19 for the sheet S is arranged. At a lower end part (upstream end part) of the conveying path 19, a sheet feeding part 20 is arranged. At an intermediate stream part of the conveying path 19, a secondary transfer roller 21 (secondary transfer member) is arranged. Between the secondary transfer roller 21 and the intermediate transfer belt 11, a secondary transfer nip N2 is formed. At an upper part (downstream part) of the conveying path 19, a fixing device 22 is arranged. The fixing device 22 includes a fixing belt 23 (fixing member) and a pressuring roller 24 (pressuring member). Between the fixing belt 23 and the pressuring roller 24, a fixing nip N is formed. At an upper end part (a downstream end part) of the conveying path 19, a sheet ejecting unit 25 is arranged. At the right side of the conveying path 19, an inversion path 26 for duplex printing is arranged.

Next, the operation of the MFP 1 will be explained.

When an instruction to start printing is given to the MFP 1, firstly, a surface of each photosensitive drum 7Y, 7C, 7M, 7K is electrically charged by the charger 8 of each image forming part 6Y, 6C, 6M, 6K. Then, an electrostatic latent image is formed on the surface of each photosensitive drum 7Y, 7C, 7M, 7K by a laser light (refer to an arrow P in FIG. 1) from the laser scanning device 17. Then, the electrostatic latent image is developed by the developing device 9 of each image forming part 6Y, 6C, 6M, 6K by using the toner supplied from each toner container 5Y, 5C, 5M, 5K, so that a toner image is formed on each photosensitive drum 7Y, 7C, 7M, 7K. The toner image (color toner image) formed on each photosensitive drum 7Y, 7C, 7M is primarily transferred to the intermediate transfer belt 11 by each primary transfer roller 12Y, 12C, 12M, respectively (these are "upstream side primary transfer steps"). The toner image (black toner image) formed on the photosensitive drum 7K is primarily transferred to the intermediate transfer belt 11 by the primary transfer roller 12K (this is a "downstream side primary transfer step"). The downstream side primary transfer step is carried out after each upstream side primary transfer step. According to this, a full-color toner image is formed on the intermediate transfer belt 11. Incidentally, the toner remained on each photosensitive drum 7Y, 7C, 7M, 7K is removed by the cleaning device 10 of each image forming part 6Y, 6C, 6M, 6K.

On the other hand, the sheet S picked from the sheet feeding tray 18 by the sheet feeding part 20 is conveyed to a downstream side of the conveying path 19 and enters the secondary transfer nip N2. In the secondary transfer nip N2, the full-color toner image formed on the intermediate transfer belt 11 is secondarily transferred to the sheet S by the secondary transfer roller 21 (This is a "secondary transfer step"). Incidentally, the toner remained on the intermediate transfer belt 11 is removed by the cleaning unit 13. Concretely, the toner remained on the intermediate transfer belt 11 is removed by the cleaning brush 14, collected from the cleaning brush 14 by the collecting roller 15, and scraped from the collecting roller 15 by the cleaning blade 16.

The sheet S to which the toner image is secondarily transferred is further conveyed to the downstream side of the conveying path 19 and enters the fixing device 22. In the fixing nip N of the fixing device 22, the toner image is fixed on the sheet S. The sheet S on which the toner image is fixed is ejected on the sheet ejecting tray 4 by the sheet ejecting unit 25.

Next, the secondary transfer roller 21 and its periphery will be explained in detail. Incidentally, an arrow Z in FIG. 2 indicates a conveying direction of the sheet S.

Figure 2:
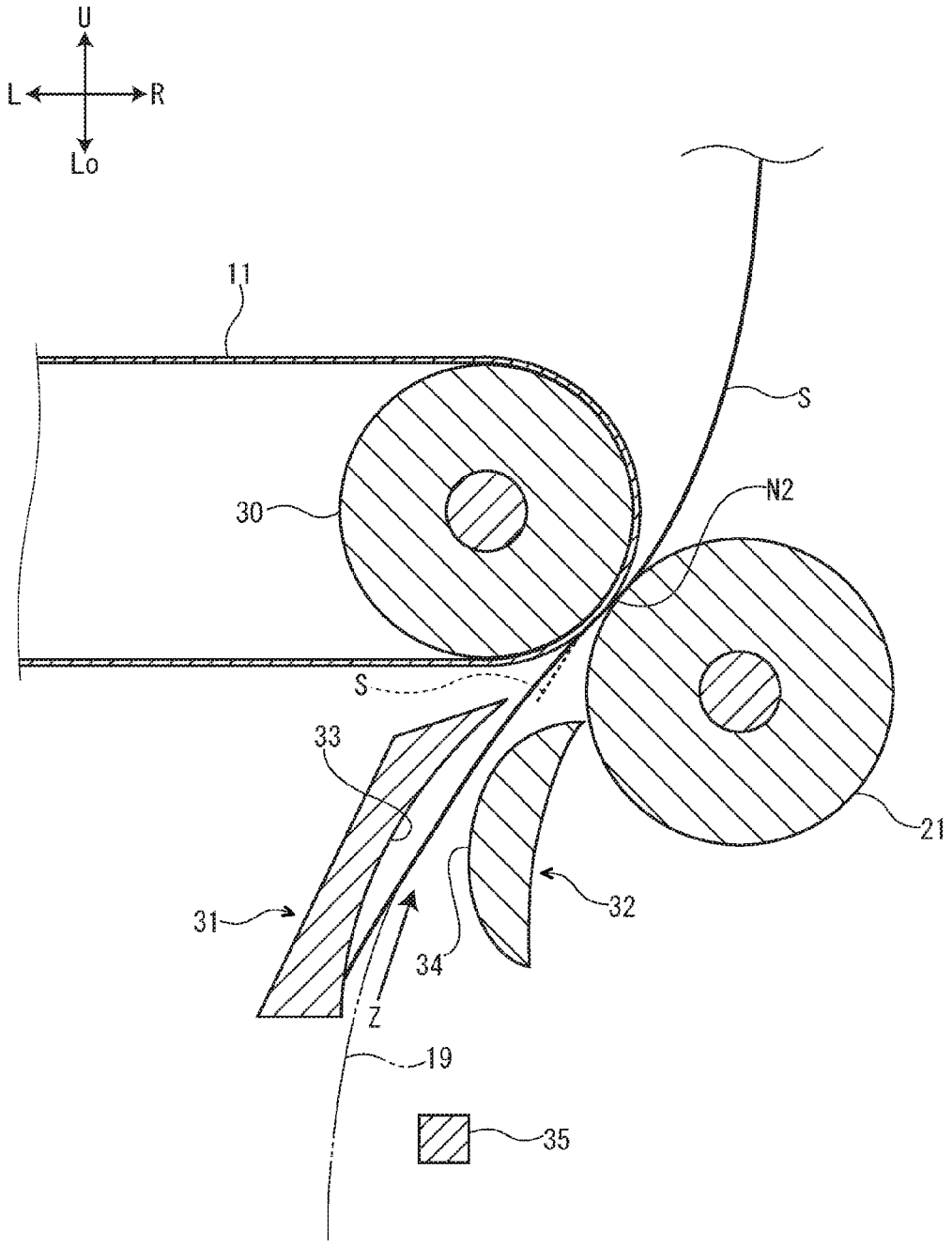
FIG. 2 is a sectional view showing a secondary transfer roller and its periphery, in the MFP according to the embodiment of the present disclosure.

As shown in FIG. 2, the secondary transfer roller 21 faces a driving roller 30 via the intermediate transfer belt 11. Around the driving roller 30, a right end part of the intermediate transfer belt 11 is wound.

At a lower left side of the secondary transfer roller 21 (an upstream side in the conveying direction of the sheet S), first and second guide members 31 and 32 are arranged. The first and second guide members 31 and 32 face each other via the conveying path 19. The first guide member 31 is arranged at a left side (a side of the intermediate transfer belt 11) of the conveying path 19. On a right face (inner face) of the first guide member 31, a first guide face 33 is formed. The first guide face 33 is curved in a shape of an arc toward a left side (a side remote from the conveying path 19). The second guide member 32 is arranged at a right side (a side of the secondary transfer roller 21) of the conveying path 19. On a left face (inner face) of the second guide member 32, a second guide face 34 is formed. The second guide face 34 is curved in a shape of an arc toward the left side (a side approaching the conveying path 19. A curvature of the arc formed by the second guide face 34 is larger than a curvature of the arc formed by the first guide face 33.

At a lower side (an upstream side in the conveying direction of the sheet S) of the first and second guide members 31 and 32, a sheet sensor 35 is arranged. The sheet sensor 35 is composed of an optical sensor, for example, and has a function of detecting the sheet S.

Next, a control system of the MFP 1 will be explained.

Figure 3:
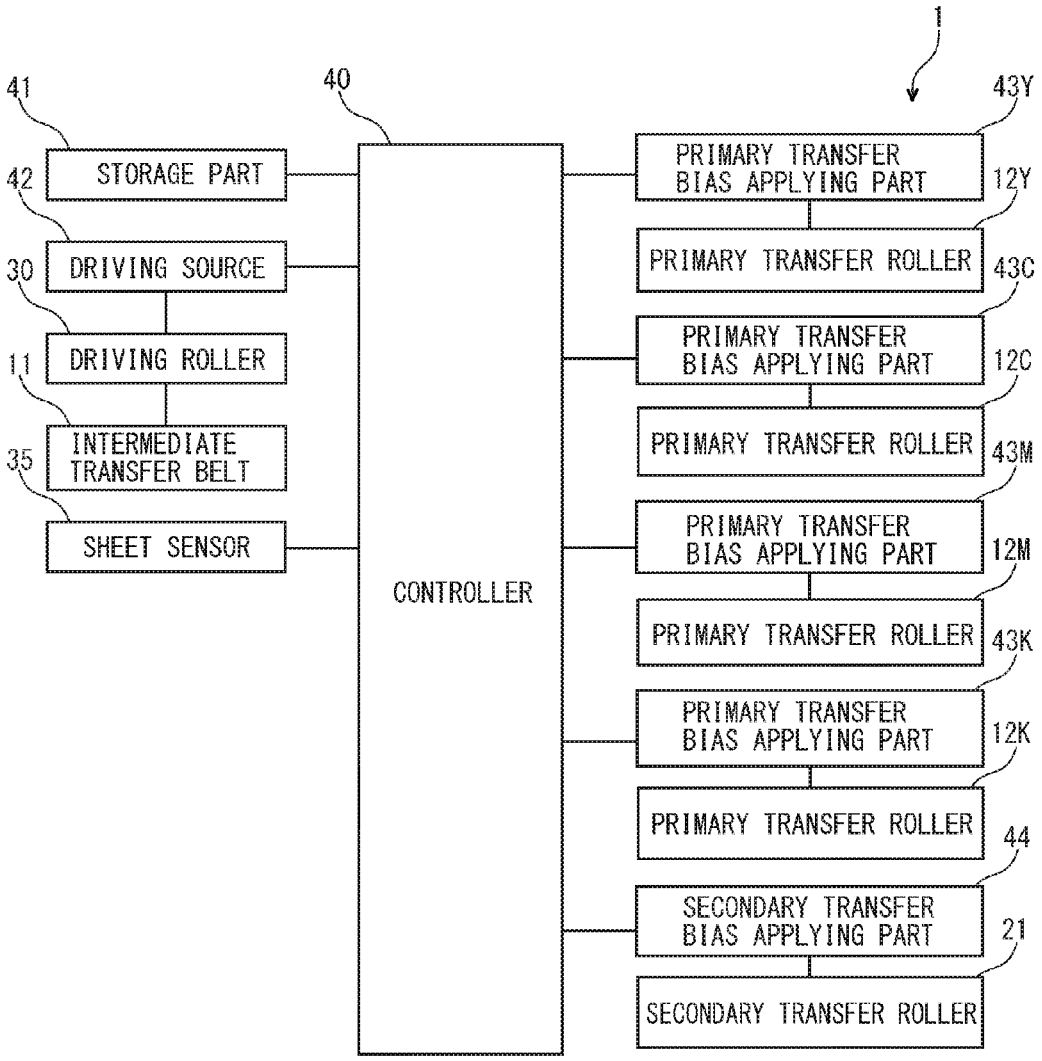
FIG. 3 is a block diagram showing a control system of the MFP according to the embodiment of the present disclosure.

As shown in FIG. 3, the MFP 1 includes a controller 40. The controller 40 is connected to a storage part 41, and the controller 40 is configured to control each part of the MFP 1 based on a control program or control data stored in the storage part 41.

The controller 40 is connected to a driving source 42 composed of a motor or the like, and the driving source 42 is connected to the driving roller 30. When the driving source 42 rotates the driving roller 30 based on a signal from the controller 40, the intermediate transfer belt 11 whose right end part is wound around the driving roller 30 runs.

The controller 40 is connected to the sheet sensor 35 and a detecting result is outputted to the controller 40 when the sheet sensor 35 detects the sheet S.

The controller 40 is connected to primary transfer bias applying parts 43Y, 43C, 43M, 43K, and each primary transfer bias applying part 43Y, 43C, 43M 43K is connected to each primary transfer roller 12Y, 12C, 12M, 12K, respectively. When the toner image on each photosensitive drum 7Y, 7C, 7M, 7K is primarily transferred to the intermediate transfer belt 11, the controller 40 controls a primary transfer bias applied from each primary transfer bias applying part 43Y, 43C, 43M, 43K to each primary transfer roller 12Y, 12C, 12M, 12K.

The controller 40 is connected to a secondary transfer bias applying part 44, and the secondary transfer bias applying part 44 is connected to the secondary transfer roller 21. When the toner image on the intermediate transfer belt 11 is secondarily transferred to the sheet S, the controller 40 controls a secondary transfer bias applied from the secondary transfer bias applying part 44 to the secondary transfer roller 21.

When the sheet S passes through the secondary transfer nip N2 in the MFP 1 applying the above-mentioned configuration, as shown in FIG. 2, the first and second guide members 31 and 32 guide the sheet S along the conveying direction (this is a "guide step"). At this time, a lower end part (an end part at an upstream side in the conveying direction) of the sheet S moves in a state of coming into contact with the first guide face 33 of the first guide member 31.

Incidentally, a start timing of the above-mentioned guide step is earlier than a start timing of the above-mentioned secondary transfer step. Further, an end timing of the above-mentioned guide step is later than the start timing of the secondary transfer step and is earlier than an end timing of the above-mentioned secondary transfer step. That is, the above-mentioned guide step is carried out so as to be finished during the above-mentioned secondary transfer step.

Meanwhile, when the lower end part of the sheet S passes through the first guide face 33 of the first guide member 31, the lower end part of the sheet S separates from the first guide face 33 of the first guide member 31 (see a dotted line in FIG. 2). According to this, a posture of the lower end part of the sheet S becomes unstable and the lower end part of the sheet S is significantly displaced in some cases. When such a phenomenon occurs, there is a concern that electric discharge occurs in a surrounding area of the secondary transfer roller 21, and a transfer failure (so-called "void"), which brings about loss of a part of an image, occurs. Such a transfer failure occurs in particular when the image is printed on a relatively stiff sheet S, such as a cardboard or an OHP sheet (Overhead Projector sheet).

Hence, the controller 40 lowers an absolute value of the secondary transfer bias when the lower end part of the sheet S separates from the first guide face 33 of the first guide member 31 (when the guide step is finished). In other words, the controller 40 makes the absolute value of the secondary transfer bias after the lower end part of the sheet S separates from the first guide face 33 of the first guide member 31 smaller than the absolute value of the secondary transfer bias when the lower end part of the sheet S comes into contact with the first guide face 33 of the first guide member 31. By performing such control, it is possible to prevent occurrence of the electric discharge in the surrounding area of the secondary transfer roller 21 when the guide step is finished, so that, even when the image is printed on the relatively stiff sheet S, such as the cardboard or the OHP sheet, the transfer failure hardly occurs.

Incidentally, for example, the controller 40 calculates a time at which the lower end part of the sheet S separates from the first guide face 33 of the first guide member 31, by adding a time the lower end part of the sheet S takes to move from a detecting position of the sheet sensor 35 to an upper end part of the first guide face 33 of the first guide member 31 to a time at which the sheet sensor 35 detects the lower end part of the sheet S. Incidentally, the controller 40 may lower the absolute value of the secondary transfer bias simultaneously with the separation of the lower end part of the sheet S from the first guide face 33 of the first guide member 31, or may lower the absolute value of the secondary transfer bias immediately before or immediately after the lower end part of the sheet S separates from the first guide face 33 of the first guide member 31.

By the way, in the present embodiment, at the downstream side of each primary transfer roller 12Y, 12C, 12M (each color primary transfer roller) in the running direction of the intermediate transfer belt 11 (see the arrows X in FIG. 1), the primary transfer roller 12K (black primary transfer roller) is arranged. According to this relationship, when a color toner image is primarily transferred to the intermediate transfer belt 11 by each primary transfer roller 12Y, 12C, 12M, and then passes through the primary transfer roller 12K, a charging amount of the color toner image increases. Meanwhile, a black toner image is primarily transferred to the intermediate transfer belt 11 by the primary transfer roller 12K and then does not pass through another primary transfer roller, and therefore a charging amount of the black toner image does not increase. Hence, the charging amount of the color toner image is likely to be higher than the charging amount of the black toner image, and the charging amount of the toner image on the intermediate transfer belt 11 is likely to be uneven.

When the charging amount of the toner image on the intermediate transfer belt 11 becomes uneven as mentioned above, a range of the secondary transfer bias which causes the electric discharge becomes different by each color, and it becomes difficult to prevent the transfer failure due to the electric discharge during secondary transfer for all colors. Hence, it is necessary to make the charging amount of the toner image on the intermediate transfer belt 11 uniform.

However, by controlling the secondary transfer bias as described above, it is not possible to make the charging amount of the toner image on the intermediate transfer belt 11 uniform. Hence, by controlling the secondary transfer bias as described above, it is not possible to reliably prevent occurrence of the transfer failure for all of the color toner image, the black toner image, and a secondary color toner image (toner image obtained by overlaying color toner images).

Hence, the controller 40 makes an absolute value of the primary transfer bias applied to the primary transfer roller 12K larger than an absolute value of the primary transfer bias applied to each primary transfer roller 12Y, 12C, 12M. By performing such control, it is possible to increase the charging amount of the black toner image, to prevent the charging amount of the color toner image from getting larger than the charging amount of the black toner image and to make the charging amount of the toner image on the intermediate transfer belt 11 uniform. Consequently, it is possible to reliably prevent the occurrence of the transfer failure for all of the color toner image, the black toner image and the secondary color toner image.

By the way, when the MFP 1 applying the above-mentioned configuration performs the duplex printing, the secondary transfer roller 21 secondarily transfers the toner image to a first face of the sheet S, and the toner image is fixed to the first face of the sheet S in the fixing nip N of the fixing device 22. Thus, the image is printed on the first face of the sheet S. Next, the sheet S is conveyed to the inversion path 26 to invert the sheet S having the first face and a second face. Further, the secondary transfer roller 21 secondarily transfers the toner image to the second face (a face at a side opposite to the first face) of the sheet S, the toner image is fixed to the second face of the sheet S in the fixing nip N of the fixing device 22. Thus, the image is printed on the second face of the sheet S, and the duplex printing is finished.

Figure 4:
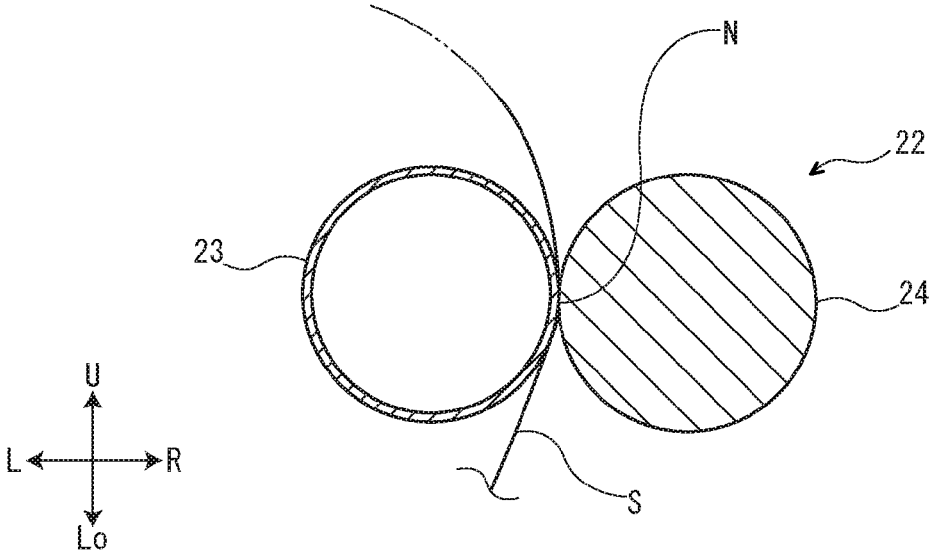
FIG. 4 is a sectional view showing a state where a sheet passes through a fixing nip of a fixing device when an image is printed on a first face of the sheet, in the MFP according to the embodiment of the present disclosure.
Figure 5:
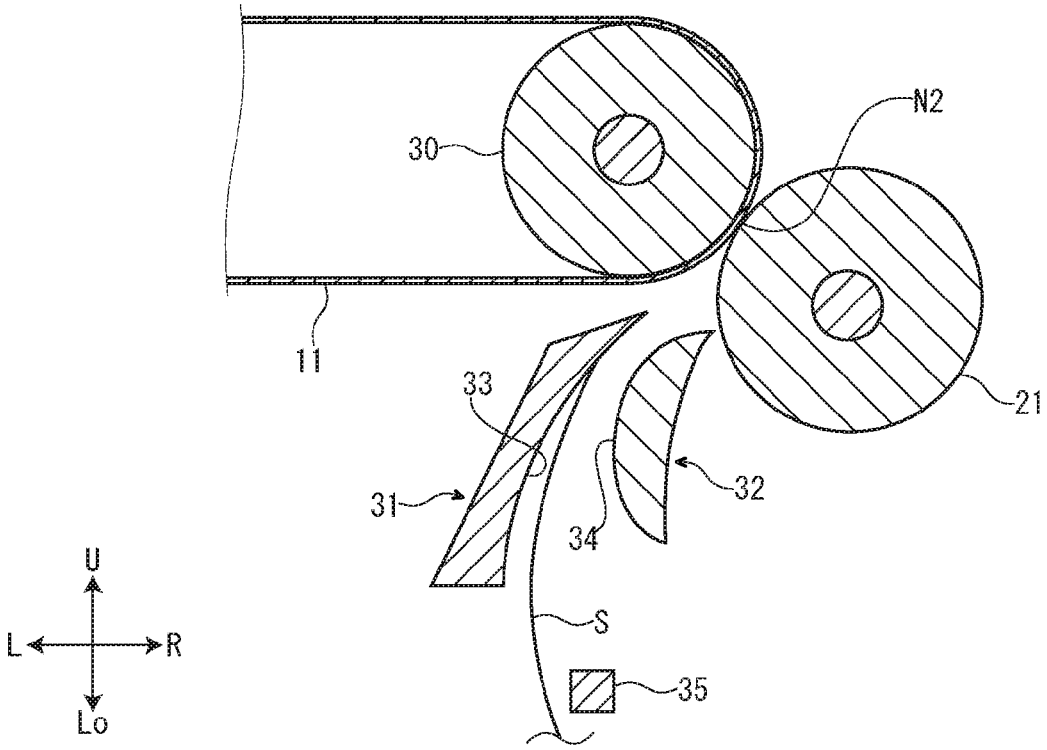
FIG. 5 is a sectional view showing a state before the sheet enters a secondary transfer nip when the image is printed on a second face of the sheet, in the MFP according to the embodiment of the present disclosure.

When the image is printed on the first face of the sheet as mentioned above, and when the sheet passes through the fixing nip N of the fixing device 22, as shown in FIG. 4, the sheet S is curled leftward (a side of the fixing belt 23). When the sheet S curved leftward in this way is inverted in the inversion path 26, as shown in FIG. 5, the sheet S is curled rightward. According to this relationship, it is more likely that the lower end part of the sheet S is significantly displaced when the lower end part of the sheet S separates from the first guide face 33 of the first guide member 31, and the transfer failure is more likely to occur in a case where the image is printed on the second face of the sheet than in a case where the image is printed on the first face of the sheet S.

Hence, the controller 40 makes a separating absolute value (an absolute value of the secondary transfer bias after the lower end part of the sheet S separates from the first guide face 33 of the first guide member 31) smaller and makes a downstream side absolute value (an absolute value of the primary transfer bias applied to the primary transfer roller 12K) smaller in the case where the image is printed on the second face of the sheet S than in the case where the image is printed on the first face of the sheet S. By performing such control, it is possible to reliably prevent the occurrence of the transfer failure both in the case where the image is printed on the first face of the sheet S and in the case where the image is printed on the second face of the sheet S.

Further, values of the primary transfer bias and the secondary transfer bias to be needed are different in a case where temperature and humidity inside the MFP 1 are relatively high and in a case where the temperature and the humidity inside the MFP 1 are relatively low. Hence, there is a concern that the transfer failure occurs if the values of the primary transfer bias and the secondary transfer bias are the same in the case where the temperature and the humidity inside the MFP 1 are relatively high and in the case where the temperature and the humidity inside the MFP 1 are relatively low.

Hence, the controller 40 increases the absolute values of the primary transfer bias and the secondary transfer bias according to an increase of the temperature and the humidity inside the MFP 1. By performing such control, it is possible to optimize the absolute values of the primary transfer bias and the secondary transfer bias according to the temperature and the humidity inside the MFP 1.

Further, in the present embodiment, the primary transfer rollers 12Y, 12C, 12M primarily transfer the color toner image to the intermediate transfer belt 11 and the primary transfer roller 12K primarily transfers the black toner image to the intermediate transfer belt 11. By applying such a configuration, it is possible to reliably transfer both of the color and black toner images to the sheet.

In the present embodiment, the absolute values of the primary transfer bias and the secondary transfer bias are increased according to the increase of the temperature and the humidity inside the MFP 1. In other embodiments, the absolute values of the primary transfer bias and the secondary transfer bias may be increased according to the increase of one of the temperature and the humidity inside the MFP 1.

In the present embodiment, the time at which the lower end part of the sheet S separates from the first guide face 33 of the first guide member 31 is calculated by adding the time the lower end part of the sheet S takes to move from the detecting position of the sheet sensor 35 to the upper end part of the first guide face 33 of the first guide member 31 to the time at which the sheet sensor 35 detects the lower end part of the sheet S. In other embodiments, the time at which the lower end part of the sheet S separates from the first guide face 33 of the first guide member 31 may be calculated by adding the time the lower end part of the sheet S takes to move from a starting position of conveyance to the upper end part of the first guide face 33 of the first guide member 31 to the time at which the conveyance of the sheet S is started. That is, the detecting result of the sheet sensor 35 may or may not be used when the time at which the lower end part of the sheet S separates from the first guide face 33 of the first guide member 31 is calculated.

Control of the secondary transfer bias (control of lowering the absolute value of the secondary transfer bias when the lower end part of the sheet S separates from the first guide face 33 of the first guide member 31) and control of the primary transfer bias (control of making the absolute value of the primary transfer bias applied to the primary transfer roller 12K larger than the absolute value of the primary transfer bias applied to the primary transfer rollers 12Y, 12C, 12M) according to the present embodiment may be applied to the case where the image is printed on the sheet S of all sorts, or may be applied to only the case where the image is printed on the relatively stiff sheet, such as the cardboard or the OHP sheet. Especially, the control of the primary and secondary transfer biases according to the present embodiment may preferably be applied to a case where the image is printed on the cardboard which has a basis weight of not less than 200 g/m^2.

In the present embodiment, the configuration of the present disclosure is applied to the MFP 1. In other embodiments, the configuration of the present disclosure may be applied to an image forming apparatus other than the MFP 1, such as a copying machine, a scanner, or a facsimile.

EXPERIMENT

Experiments were conducted to prove an effect of the present disclosure by performing control according to examples of the present disclosure and control according to comparative examples.

(Experiment Conditions)

Under a normal temperature and normal humidity environment (an environment in which temperature is 23° C. and humidity is 50%), a high temperature and high humidity environment (an environment in which temperature is 32.5° C. and humidity is 80%) and a low temperature and low humidity environment (an environment in which temperature is 10° C. and humidity is 10%), the experiments to transfer the toner image to the first face and the second face of the sheet S were conducted. For these experiments, a tandem-type MFP 1 including the intermediate transfer belt 11 was used. The configuration of the MFP 1 used for the experiments is the same as the configuration of the MFP 1 according to the present embodiment (see FIGS. 1 and 2), and therefore an explanation will be omitted. A linear velocity of the MFP 1 was 109 mm/sec. A cardboard of 200 g was used as the sheet S.

(Experiment Result)

FIGS. 6 to 11 show results of the experiments under each experiment condition.

In FIGS. 6 to 11, each number written below each letter of Y, C, M, and K in a field of "PRIMARY TRANSFER BIAS (−μA)" indicates the value of the primary transfer bias applied to each primary transfer roller 12Y, 12C, 12M, 12K. Each number written below "DURING CONTACT" in a field of "SECONDARY TRANSFER BIAS (−μA)" indicates a value of the secondary transfer bias when the lower end part of the sheet S comes into contact with the first guide face of the first guide member 31. Each number written below characters of "AFTER SEPARATION" in the field of "SECONDARY TRANSFER BIAS (−μA)" indicates a value of the secondary transfer bias after the lower end part of the sheet S separates from the first guide face 33 of the first guide member 31. ○ or X written below each letter of Y, C, M, K and Blue in a field of "TRANSFER RESULT" indicates a result, which is obtained by visually checking, as to whether or not the transfer failure of the toner image of yellow, cyan, magenta, black and blue occurred. Incidentally, a 100% solid toner image of primary colors of yellow, cyan, magenta and black was transferred to the sheet, and a 200% solid toner image of a secondary color of blue obtained by overlaying a 100% solid toner image of magenta and a 100% solid toner image of cyan was transferred to the sheet.

In FIGS. 6 to 11, comparative example 1 is an example where both of the control to lower the absolute value of the secondary transfer bias when the lower end part of the sheet S separates from the first guide face 33 of the first guide member 31 and the control to make the absolute value of the primary transfer bias applied to the primary transfer roller 12K larger than the absolute value of the primary transfer bias applied to each primary transfer roller 12Y, 12C, 12M were not performed. Comparative examples 2 and 3 are examples where the control to lower the absolute value of the secondary transfer bias when the lower end part of the sheet S separates from the first guide face 33 of the first guide member 31 was performed, but the control to make the absolute value of the primary transfer bias applied to the primary transfer roller 12K larger than the absolute value of the primary transfer bias applied to each primary transfer roller 12Y, 12C, 12M was not performed. The examples 1 and 2 are examples where both of the control to lower the absolute value of the secondary transfer bias when the lower end part of the sheet S separates from the first guide face 33 of the first guide member 31 and the control to make the absolute value of the primary transfer bias applied to the primary transfer roller 12K larger than the absolute value of the primary transfer bias applied to each primary transfer roller 12Y, 12C, 12M were performed. Incidentally, according to the examples 1 and 2, the secondary transfer bias was lowered when a lower part of the sheet S (a part which is 7 mm above the lower end part of the sheet S) passed through the secondary transfer nip N2, and the secondary transfer bias was switched to an inverse polarity when the lower end part of the sheet S passed through the secondary transfer nip N2.

As shown in FIGS. 6 to 11, under all experiment conditions, the transfer failure occurred in a part of colors or all of the colors with regard to comparative examples 1 to 3. This shows that it is not possible to sufficiently prevent the transfer failure by performing the control according to comparative examples 1 to 3. By contrast with this, under all experiment conditions, the transfer failure of the image of any color did not occur in the examples 1 and 2. This shows that, by performing the control according to the examples 1 and 2 of the present disclosure, it is possible to reliably prevent the transfer failure.

Further, as shown in FIGS. 6 and 7, it is possible to reliably prevent the transfer failure by making the absolute value of the secondary transfer bias after the lower end part of the sheet S separates from the first guide face 33 of the first guide member 31 smaller in the case where the image is printed on the second face of the sheet S than in the case where the image is printed on the first face of the sheet S.

Furthermore, as shown in FIGS. 6 and 7, it is possible to reliably prevent the transfer failure by making the absolute value of the primary transfer bias applied to the primary transfer roller 12K smaller in the case where the image is printed on the second face of the sheet S than in the case where the image is printed on the first face of the sheet S.

Still further, as shown in FIGS. 6 and 8, by increasing the absolute values of the primary transfer bias and the secondary transfer bias according to the increase of the temperature and the humidity inside the MFP 1, it is possible to reliably prevent the transfer failure.

As shown in FIG. 6, when the toner image is transferred to the first face of the sheet S under the normal temperature and normal humidity environment, the primary transfer bias applied to the primary transfer roller 12K is preferably 7 to 10 (−μA). As shown in FIG. 7, when the toner image is transferred to the second face of the sheet S under the normal temperature and normal humidity environment, the primary transfer bias applied to the primary transfer roller 12K is preferably 6 to 9 (−μA). As shown in FIGS. 8 and 9, when the toner image is transferred to one of the first and second faces of the sheet S under the high temperature and high humidity environment, the primary transfer bias applied to the primary transfer roller 12K is preferably 10 to 14 (−μA). As shown in FIGS. 10 and 11, when the toner image is transferred to one of the first and second faces of the sheet S under the low temperature and low humidity environment, the primary transfer bias applied to the primary transfer roller 12K is preferably 7 to 11 (−μA). When the primary transfer bias applied to the primary transfer roller 12K exceeds each of the above-mentioned upper limit values, there is a concern that the color toner image is excessively charged and the transfer failure occurs during the secondary transfer of the color toner image. Meanwhile, when the primary transfer bias applied to the primary transfer roller 12K is less than each of the above-mentioned lower limit values, there is a concern that the charging amount of one or both of color and black toner images becomes insufficient and the transfer failure occurs during the secondary transfer.

Further, as described above, the sheet S is more likely to be curled rightward and therefore the electric discharge is more likely to occur during the secondary transfer, in the case where the image is printed on the second face of the sheet S than in the case where the image is printed on the first face of the sheet S. Hence, it is preferable to make a proportion of the secondary transfer bias after the separation (the secondary transfer bias after the lower end part of the sheet S separates from the first guide face 33 of the first guide member 31) to the secondary transfer bias during contact (the secondary transfer bias when the lower end part of the sheet S comes into contact with the first guide face 33 of the first guide member 31) smaller in the case where the toner image is transferred to the second face of the sheet S than in the case where the toner image is transferred to the first face of the sheet S.

For example, under the normal temperature and normal humidity environment, when the toner image is transferred to the first face of the sheet S, the proportion of the secondary transfer bias after the separation to the secondary transfer bias during the contact is 55 to 70%, and, when the toner image is transferred to the second face of the sheet S, the proportion of the secondary transfer bias after the separation to the secondary transfer bias during the contact is 30 to 50%. Further, for example, under the high temperature and high humidity environment or the low temperature and low humidity environment, when the toner image is transferred to the first face of the sheet S, the proportion of the secondary transfer bias after the separation to the secondary transfer bias during the contact is 80 to 90%, and, when the toner image is transferred to the second face of the sheet S, the proportion of the secondary transfer bias after the separation to the secondary transfer bias during the contact is 60 to 70%.

Incidentally, in the above-mentioned numerical example, the controller 40 makes the proportion (80 to 90%) of the secondary transfer bias after the separation to the secondary transfer bias during the contact in the case where the toner image is transferred to the first face of the sheet S under the high temperature and high humidity environment or the low temperature and low humidity environment larger than the proportion (55 to 70%) of the secondary transfer bias after the separation to the secondary transfer bias during the contact in the case where the toner image is transferred to the first face of the sheet S under the normal temperature and normal humidity environment. Similarly, the controller 40 makes the proportion (60 to 70%) of the secondary transfer bias after the separation to the secondary transfer bias during the contact in the case where the toner image is transferred to the second face of the sheet S in the high temperature and high humidity environment or the low temperature and low humidity environment larger than the proportion (30 to 50%) of the secondary transfer bias after the separation to the secondary transfer bias during the contact in the case where the toner image is transferred to the second face of the sheet S in the normal temperature and normal humidity environment. That is, the controller 40 makes a secondary transfer proportion (a proportion of the secondary transfer bias after the lower end part of the sheet S separates from the first guide face 33 of the first guide member 31 to the secondary transfer bias when the lower end part of the sheet S comes into contact with the first guide face 33 of the first guide member 31) larger in the case where the image is printed on the sheet S in the high temperature and high humidity environment or the low temperature and low humidity environment than in the case where the image is printed on the sheet S in the normal temperature and normal humidity environment.

While the present disclosure has been described with reference to the particular illustrative embodiments, it is not to be restricted by the embodiments. It is to be appreciated that those skilled in the art can change or modify the embodiments without departing from the scope and spirit of the present disclosure.

The invention claimed is:

1. An image forming apparatus comprising:

a plurality of image carriers configured to carry a toner image;

an intermediate transfer body configured to come into contact with a plurality of the image carriers;

a plurality of primary transfer members configured to primarily transfer the toner image on a plurality of the image carriers to the intermediate transfer body;

a secondary transfer member configured to secondarily transfer the toner image on the intermediate transfer body to a recording medium;

a guide member arranged at an upstream side of the secondary transfer member in a conveying direction of the recording medium and configured to guide the recording medium along the conveying direction; and a controller configured to control both of a primary transfer bias applied to a plurality of the primary transfer members when the toner image on a plurality of the image carriers is primarily transferred to the intermediate transfer body and a secondary transfer bias applied to the secondary transfer member when the toner image on the intermediate transfer body is secondarily transferred to the recording medium, wherein a plurality of the primary transfer members include:

an upstream side primary transfer member; and a downstream side primary transfer member arranged at a downstream side of the upstream side primary transfer member in a running direction of the intermediate transfer body, and the controller makes an absolute value of the primary transfer bias applied to the downstream side primary transfer member larger than an absolute value of the primary transfer bias applied to the upstream side primary transfer member, and the controller lowers an absolute value of the secondary transfer bias when an upstream end part of the recording medium in the conveying direction separates from the guide member.

2. The image forming apparatus according to claim 1, further comprising an inversion path configured to invert the recording medium having a first face and a second face so as to print an image on the second face of the recording medium after an image is printed on the first face of the recording medium, wherein the controller makes a separating absolute value smaller in a case where the image is printed on the second face of the recording medium than in a case where the image is printed on the first face of the recording medium, the separating absolute value being an absolute value of the secondary transfer bias after the upstream end part of the recording medium in the conveying direction separates from the guide member.

3. The image forming apparatus according to claim 1, further comprising an inversion path configured to invert the recording medium having a first face and a second face so as to print an image on the second face of the recording medium after an image is printed on the first face of the recording medium, wherein the controller makes a downstream side absolute value smaller in a case where the image is printed on the second face of the recording medium than in a case where the image is printed on the first face of the recording medium, the downstream side absolute value being an absolute value of the primary transfer bias applied to the downstream side primary transfer member.

4. The image forming apparatus according to claim 1, wherein the controller increases absolute values of the primary transfer bias and the secondary transfer bias according to an increase of at least one of temperature or humidity inside the image forming apparatus.

5. The image forming apparatus according to claim 1, wherein the upstream side primary transfer member is configured to primarily transfer a color toner image to the intermediate transfer body, and the downstream side primary transfer member is configured to primarily transfer a black toner image to the intermediate transfer body.

6. The image forming apparatus according to claim 1, wherein the controller makes a secondary transfer proportion larger in a case where an image is printed on the recording medium under a high temperature and high humidity environment or a low temperature and low humidity environment than in a case where the image is printed on the recording medium under a normal temperature and normal humidity environment, the secondary transfer proportion being a proportion of the secondary transfer bias after the upstream end part of the recording medium in the conveying direction separates from the guide member to the secondary transfer bias when the upstream end part of the recording medium in the conveying direction comes into contact with the guide member.

7. The image forming apparatus according to claim 1, wherein a guide face curved in a shape of an arc toward a side remote from a conveying path of the recording medium is arranged on an inner face of the guide member, and the upstream end part of the recording medium in the conveying direction moves in a state of coming into contact with the guide face.

8. The image forming apparatus according to claim 7, further comprising an other guide member configured to face the guide member via the conveying path, wherein an other guide face curved in a shape of an arc toward a side approaching the conveying path is arranged on an inner face of the other guide member.

9. The image forming apparatus according to claim 8, wherein a curvature of the arc formed by the other guide face is larger than a curvature of the arc formed by the guide face.

* * * * *